United States Patent [19]

Taga

[11] Patent Number: 4,698,905

[45] Date of Patent: Oct. 13, 1987

[54] APPARATUS FOR ASSEMBLING A PAIR OF FASTENER ELEMENTS

[75] Inventor: Yukio Taga, Uozu, Japan

[73] Assignee: Yoshida Kogyo K. K., Tokyo, Japan

[21] Appl. No.: 883,946

[22] Filed: Jul. 10, 1986

[30] Foreign Application Priority Data

Jul. 10, 1985 [JP] Japan ..... 60-105185[U]

[51] Int. Cl.[4] ..... B23P 19/00; B23P 11/00; B23Q 15/00

[52] U.S. Cl. ..... 29/798; 29/432; 29/708

[58] Field of Search ..... 29/432, 798, 706, 708; 227/7, 8

[56] References Cited

U.S. PATENT DOCUMENTS 4,044,445 8/1977 Douri ..... 29/706
4,135,287 1/1979 Silverbush ..... 29/432
4,391,358 7/1983 Haeger ..... 29/708
4,586,248 5/1986 Ho ..... 29/708
4,598,468 7/1986 Yosheida ..... 227/7

*Primary Examiner*—Howard N. Goldberg
*Assistant Examiner*—Steven Nichols
*Attorney, Agent, or Firm*—Hill, Van Santen, Steadman & Simpson

[57] ABSTRACT

A fastener-assembling apparatus has a safety device including a vertically movably safe-confirmation member which is normally disposed in its lowermost position in which the gap between the safe-confirmation member and a die is substantially equal to the thickness of a garment fabric. In its lowermost position, the safe-confirmation member maintains a limit switch closed to continue a power supply to a drive for a punch. When the operator's finger or a tool is inadvertently inserted into the gap between the safe-confirmation member and the die, the safe-confirmation member is raised to open the limit switch to discontinue the power supply to the punch.

6 Claims, 6 Drawing Figures

APPARATUS FOR ASSEMBLING A PAIR OF FASTENER ELEMENTS

BACKGROUND OF THE INVENTION

1. Field of the Invention

The present invention relates to an apparatus for assembling a pair of fastener elements of a garment fastener, such as a snap fastener, a button and an ornament, with a garment fabric disposed between the two fastener elements.

2. Description of the Prior Art

Various fastener-assemblying apparatus are known in which a pair of fastener elements of a garment fastener is supported on a lower or die unit and an upper or punch unit, respectively; a punch of the upper unit moves toward a die of the lower unit to join the two fastener elements together in clinched condition, with a garment fabric sandwiched between the two fastener elements. With such known apparatus, there would be a danger that the operator's finger or a tool would be inadvertently jammed between the die and punch.

To this end, an improved fastener-attaching apparatus has been proposed which has a safe-confirmation member movable between an uppermost position in which the safe-confirmation member is disposed around the punch retracted from the die and a lowermost position in which the safe-confirmation member is disposed around the die in the absence of any obstacle near the die. When the safe-confirmation member arrives at the lowermost position, a detecting means produces a command signal to start lowering of the punch toward the die. However, such prior art apparatus is disadvantageous in that since the safe-confirmation member is lowered ahead of the punch, high-speed attaching of the garment fasteners cannot be achieved.

SUMMARY OF THE INVENTION

It is therefore an object of the present invention to provide a fastener-assembling apparatus having a safety device which secures safety of the operator without the risk of reducing the speed of attaching the garment fasteners.

According to the present invention, a fastener-assembling apparatus has a safety device including a vertically movable safe-confirmation member which is normally disposed in its lowermost position in which the gap between the safe-confirmation member and a die is substantially equal to the thickness of a garment fabric. In its lowermost position, the safe-confirmation member maintains a limit switch closed to continue a power supply to a drive for a punch. When the operator's finger or a tool is inadvertently inserted into the gap between the safe-confirmation member and the die, the safe-confirmation member is raised to open the limit switch to discontinue the power supply to the punch.

Many other advantages, features and additional objects of the present invention will become manifest to those versed in the art upon making reference to the detailed description and the accompanying drawings in which three preferred embodiments incorporation the principles of the present invention are shown by way of illustrative example.

DETAILED DESCRIPTION

Figure 1:
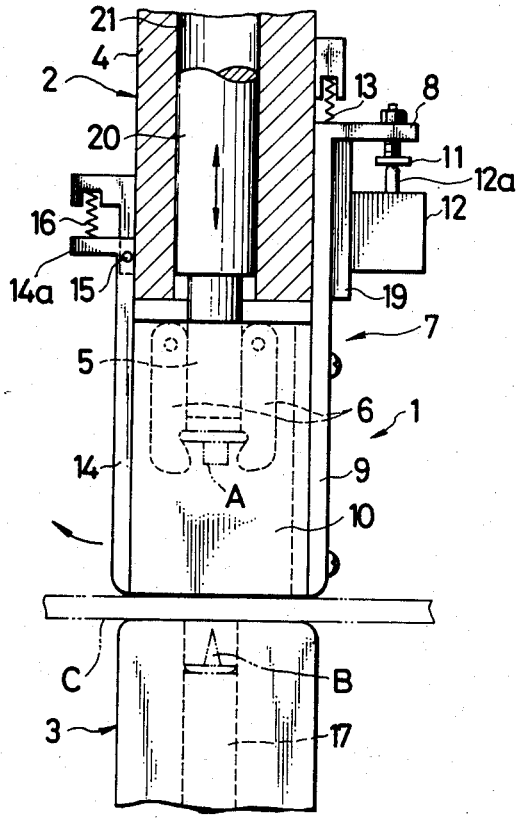
FIG. 1 is a fragmentary side elevational view, partly in cross section, of a fastener-assembling apparatus embodying the present invention.
Figure 2:
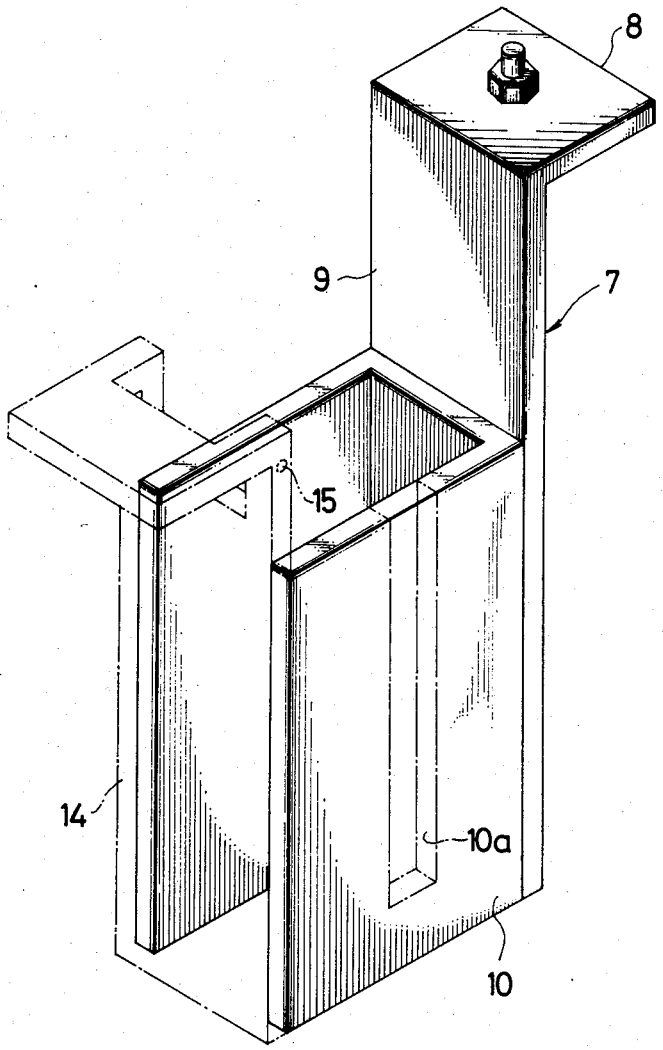
FIG. 2 is an enlarged perspective view of a guard of a safety device of FIG. 1.

FIG. 1 shows an apparatus 1 for joining a pair of first and second fastener elements A, B (illustrated in phantom lines) together, with a garment fabric C (illustrated in phantom lines). The apparatus 1 generally comprises an upper or punch unit 2 and a lower or die unit 3, both supported by a frame (not shown) in confronting relation to each other. In the illustrated embodiment, the first and second fastener elements A, B comprise a button and a tack, respectively. The button A has a head and a shank projecting centrally therefrom, and the tack B has a head and a spike projecting centrally therefrom.

The lower unit 3 includes a base (not shown) fixedly supported by the non-illustrated frame, and a die 17 supported on the non-illustrated base for receiving on its upper end surface the head of the second fastener element B with the spike directed upwardly.

The upper unit 2 includes a support 4 integral with the non-illustrated frame and a vertical bore 21, and a plunger 20 of circular cross section operatively connected to a suitable drive (not shown) for reciprocating movement within the vertical bore 21 in the support 4. The upper unit 2 also includes a pair of grip members 6, 6 carried on a lower end of the plunger 20 for clamping the first fastener element A with the shank directed downwardly, and a punch 5 secured to the lower end of the plunger 20 and movable toward and away from the die 17, in response to the reciprocating movement of the plunger 20, for forcing the first fastener element A against the second fastener element B.

Figure 5:
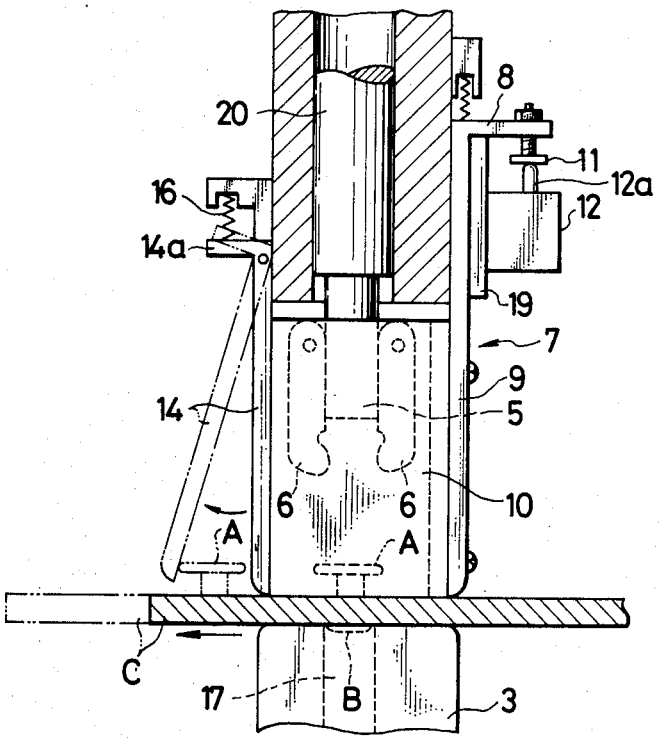
FIG. 5 is a view similar to FIG. 1, illustrating the manner is which a garment fastener is attached.

Most importantly, the apparatus 1 has a safety device including a safe-confirmation member 7 (FIGS. 1, 2, 5 and 6) which is vertically movably mounted on the support 4 and which is normally urged by a first compression spring 13 to its lowermost position (FIGS. 1 and 5).

The safe-confirmation member 7 includes a slide 9 having a first flange 8 at its upper end, and a fabric presser 10 attached to the slide 9.

The slide 9 is vertically slidably supported on the support 4 and is normally urged downwardly by the first compression spring 13. The downward movement of the slide 9 is limited by a stop 19 to such an extent that the gap between there is a lower end of the slide 9 and the upper end surface of the lower unit 3, the stop 19 being fixed to the support 4. A pusher 11 in the form of a screw is adjustably mounted on the first flange 8 of the slide 9 for depressing an actuator **12*a* of the limit switch 12 while the slide 9 is in its lowermost position (FIGS. 1 and 5). With the actuator 12*a* depressed, the limit switch 12 is closed to continue a power supply to a drive (not shown) for lowering the plunger 20; in this condition, when a foot pedal (not shown) is stepped on to actuate the drive of the plunger 20, the punch 5** is lowered to join the first and second fastener members A, B together with the garment fabric C sandwiched therebetween.

The fabric presser 10 has a lower end surface horizontally aligned with the lower end of the slide 9 for pressing the garment fabric C against the upper end surface of the lower unit 3 while the slide 9 is in its lowermost position. The fabric presser 10 has a generally C-shaped cross section defining a cavity so as not to hinder the vertical movement of the punch 5 and the grip members 6, 6. Preferably, at least a front wall of the fabric presser 10 is transparent so that the operator can observe the garment fastener being attached to the garment fabric C. Alternatively, the front wall of the fabric presser 10 may be opaque and may have a slit 10*a* as indicated in phantom lines in FIG. 2.

Figure 6:
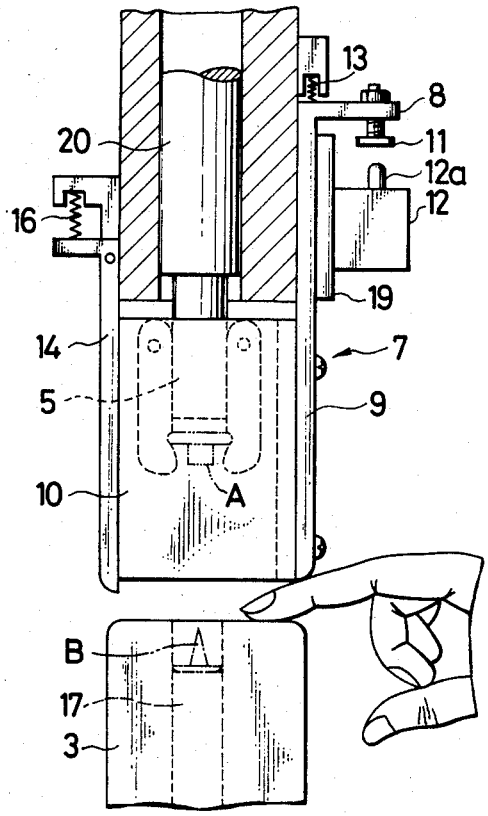
FIG. 6 is a view similar to FIG. 1, illustrating the operation of the safety device.

With the safe-confirmation member 7 in its lowermost position (FIGS. 1 and 5), if the operator's finger, for example, is inadvertently inserted into the gap between the safe-confirmation member 7 and the lower unit 3, as shown in FIG. 6, the slide 9 together with the fabric presser 10 is raised against the bias of the first compression spring 13, thus bringing the pusher 11 off the actuator 12*a* of the limit switch 12. As a result, the limit switch 12 has been opened to cut off the power supply to the non-illustrated drive of the plunger 20. In this condition, even if the non-illustrated foot pedal is stepped on, the drive of the plunger 20 cannot be actuated, that is, lowering of the punch 5 cannot take place.

Figure 4:
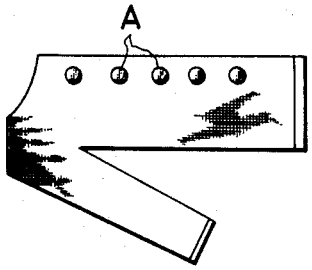
FIG. 4 is a schematic plan view of a garment to which a number of garment fasteners have been attached by the apparatus.

The open side (remote from the slide 9) of the fabric presser 10 is normally covered by a cover 14 (FIGS. 1, 2, 5 and 6) for preventing the operator's finger from inadvertently entering the hollow of the fabric presser 10 and hence from being hit by the punch 5. The cover 14 is pivotally connected at its upper end portion to the support 4 by a pin 15 and has at its upper end a second flange 14*a* on which a second compression spring 16 acts to normally urge the cover 14 to pivot counterclockwise about the pin 15. The second compression spring 16 is relatively weak so that the cover 14 can pivot clockwise about the pin 15 against the bias of the second compression spring 16 as the garment fabric C is drawn leftwardly in FIG. 5 after the garment fastener has been attached to the garment fabric C. Thus the cover 14 does not impair the rate of production in the manufacture of a garment such as shown in FIG. 4 in which a number of fastener elements are to be attached successively to the garment fabric C.

Figure 3:
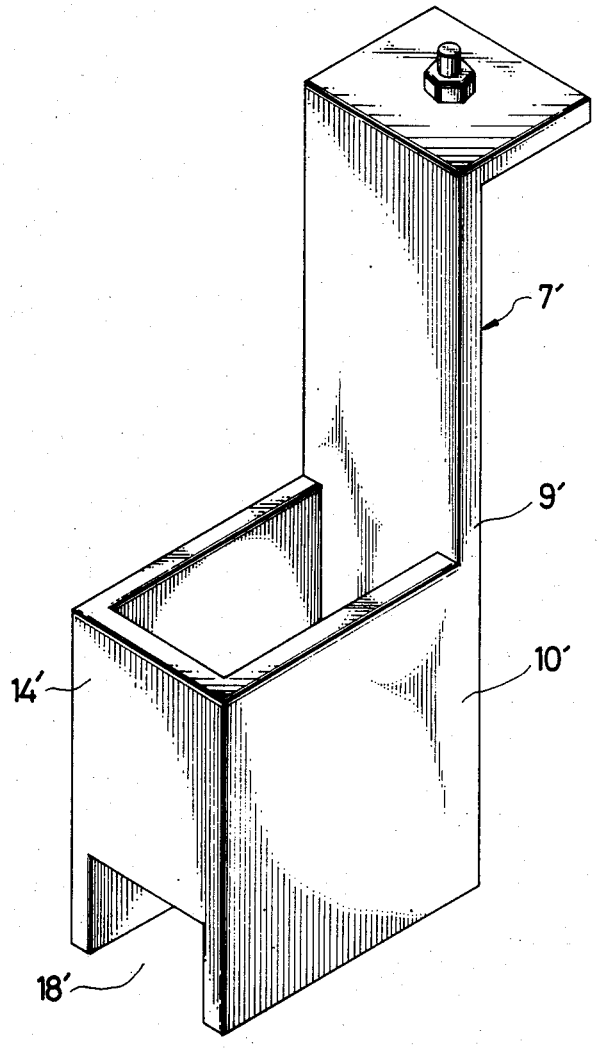
FIG. 3 is a view similar to FIG. 2, showing a modified guard.

FIG. 3 shows a modified safe-confirmation member 7' in which the slide 9', the fabric presser 10' and the cover 14' are integral with one another, the cover 14' having at its lower portion an opening 18' for the passage of the first fastener member A.

In operation, a garment fabric C is placed between the safe-confirmation member 7 and the lower unit 3 as shown in FIG. 1, at which time the slide 9 together with the fabric presser 10 is maintained in its lowermost position under the bias of the first compression spring 13. While the slide 9 is thus in its lowermost position, the pusher 11 mounted on the first flange 8 of the slide 14 depresses the actuator 12*a* of the limit switch 12 to continue the power supply to the non-illustrated drive of the plunger 20. In this condition, when the non-illustrated foot pedal is stepped on to actuate the drive (not shown) of the plunger 20, the punch 5 is lowered to join the first and second fastener members A, B together in clinched form, with the garment fabric C sandwiched therebetween.

After the garment fastener has thus been attached to the garment fabric C, when the garment fabric C is drawn leftwardly, the cover 14 pivots clockwise about the pin 15 against the bias of the second compression spring 16 as the lower end of the cover 14 is pushed by the head of the attached first fastener element A. Since the cover 14 thus does not prevent the first fastener member A to pass, the apparatus 1 enables an adequate rate of production when used in the manufacture of a garment (FIG. 4) such as of denim, in which a number of garment fasteners are to be attached successively to the garment fabric C.

With the safe-confirmation member 7 in its lowermost position (FIGS. 1 and 5), if the operator's finger, for example, is inadvertently inserted into the gap between the safe-confirmation 7 and the lower unit 3 as shown in FIG. 6, the slide 9 together with the fabric presser 10 is raised against the bias of the first compression spring 13, thus bringing the pusher 11 off the actuator 12*a* of the limit switch 12. As a result, the limit switch 12 has been opened to cut off the power supply to the drive (not shown) of the plunger 20. In this condition, even if the foot pedal (not shown) is stepped on, the drive of the plunger 20 cannot be actuated, that is, lowering of the punch 5 cannot take place, thus avoiding any accident in which the operator' finger (or a tool) inadvertently inserted could be hit by the punch 5.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for assembling a pair of fastener elements of a garment fastener with a garment fabric disposed therebetween, said apparatus comprising:

(a) a frame;

(b) a die supported by said frame for supporting one of the fastener elements;

(c) a vertically movable plunger supported by said frame and carrying a punch in confronting relation to said die for supporting the other fastener element;

(d) drive means for moving said plunger and hence said punch vertically toward and way from said die to join the two fastener elements together; and (e) a safety device including (b 1) a safe-confirmation member vertically movably supported by said frame and disposed normally in its lowermost position in which a gap between said safe confirmation member and said die is substantially equal to the thickness of the garment fabric, said safe-confirmation member being upwardly movable when an obstacke is inadvertently inserted into said gap between said safe-confirmation member and said die, and (2) a limit switch normally closed to continue a power supply to said drive means while said safe-confirmation member is disposed in said lowermost position, said limit switch being openable to discontinue the power supply to said drive means when said safe-confirmation member is moved upwardly from said lowermost position;

said safe-confirmation member including a slide vertically movably supported by said frame and normally urged downwardly to said lowermost position by a first compression spring, said slide carrying a pusher for depressing an actuator of said limit switch while said slide is disposed in said lowermost position; and a fabric presser defining a cavity for the passage of said punch and having a lower end surface horizontally aligned with a lower end of said slide, said fabric presser being vertically movable with said slide for pressing the garment fabric against said die while said slide is disposed in said lowermost position.

2. An apparatus according to claim 1, said fabric presser having a generally C-shaped horizontal cross section with one vertical side opening for passage of one fastener element when the garment fabric is drawn after the garment fastener has been attached to the garment fabric, said safety device further including a cover for normally closing said one verticle side opening and for opening the same when said cover is pushed outwardly by the one fastener element as the garment fabric is drawn.

3. An apparatus according to claim 2, said cover being pivotally supported by said frame and being normally urged against said fabric presser by a second compression spring.

4. An apparatus according to claim 1, said fabric presser being transparent at least at its front wall.

5. An apparatus according to claim 1, said fabric presser having a slit at least in its front wall.

6. An apparatus according to claim 1, said slide and said fabric presser being integral with each other, said fabric presser having an opening in a lower portion of its one side wall remote from said slide.

* * * * *